US008006408B2

(12) United States Patent
Leedy et al.

(10) Patent No.: US 8,006,408 B2
(45) Date of Patent: Aug. 30, 2011

(54) IMPACT-ATTENUATING ELEMENTS REMOVABLY MOUNTED IN FOOTWEAR OR OTHER PRODUCTS

(75) Inventors: Gregory Ross Leedy, Milwaukie, OR (US); Anthony Carl Dean, Sherwood, OR (US); Christopher S. Cook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 12/465,546

(22) Filed: May 13, 2009

(65) Prior Publication Data

US 2009/0217548 A1 Sep. 3, 2009

Related U.S. Application Data

(62) Division of application No. 10/997,981, filed on Nov. 29, 2004, now abandoned.

(51) Int. Cl.
*A43B 13/18* (2006.01)
*A43B 3/24* (2006.01)

(52) U.S. Cl. ..... 36/28; 36/100; 36/15; 36/103

(58) Field of Classification Search ..... 36/28, 100, 36/15, 103, 25 R, 30 R
See application file for complete search history.

(56) References Cited

U.S. PATENT DOCUMENTS

| | | | | |
|---|---|---|---|---|
| 1,516,384 | A | | 11/1924 | Kamada |
| 2,932,099 | A | | 4/1960 | Dardig |
| 3,063,168 | A | | 11/1962 | Cortina |
| 3,886,674 | A | | 6/1975 | Pavia |
| 4,698,923 | A | | 10/1987 | Arff |
| 4,942,677 | A | | 7/1990 | Flemming et al. |
| 5,410,821 | A | * | 5/1995 | Hilgendorf ..... 36/100 |
| 5,615,497 | A | | 4/1997 | Meschan |
| 5,797,199 | A | | 8/1998 | Miller et al. |
| 5,799,417 | A | * | 9/1998 | Burke et al. ..... 36/105 |
| 6,023,859 | A | * | 2/2000 | Burke et al. ..... 36/105 |
| 6,813,847 | B2 | * | 11/2004 | Workman ..... 36/15 |
| 6,968,636 | B2 | * | 11/2005 | Aveni et al. ..... 36/28 |
| 7,331,123 | B2 | * | 2/2008 | Workman et al. ..... 36/15 |
| 7,520,069 | B2 | * | 4/2009 | Workman et al. ..... 36/15 |
| 2001/0052195 | A1 | | 12/2001 | Blakey |
| 2004/0128860 | A1 | | 7/2004 | Smaldone et al. |
| 2005/0252038 | A1 | | 11/2005 | Braunschweiler |

FOREIGN PATENT DOCUMENTS

| | | |
|---|---|---|
| WO | 96/13995 | 5/1996 |

OTHER PUBLICATIONS

Office Action issued in corresponding European Patent Application, Application No. 05812938.8, issued Jul. 6, 2010.
First Office Action issued in corresponding Chinese Patent Application, Application No. 2005800463657, issued Dec. 26, 2008.

(Continued)

*Primary Examiner* — Ted Kavanaugh
(74) *Attorney, Agent, or Firm* — Banner & Witcoff, Ltd.

(57) ABSTRACT

Impact-attenuating elements include a plurality of impact-attenuating members and a means for releasably securing the impact-attenuating element to at least one of the upper member or the sole member of a piece of footwear or other foot-receiving device. The impact-attenuating elements may be included in the footwear or other foot-receiving devices in a selectively removable manner so that a user, retailer, or another can customize and freely select an appropriate element, e.g., depending on user preferences, characteristics of the user, characteristics of the intended use, and the like.

20 Claims, 12 Drawing Sheets

OTHER PUBLICATIONS

Second Office Action issued in corresponding Chinese Patent Application, Application No. 2005800463657, issued Aug. 21, 2009.
Third Office Action issued in corresponding Chinese Patent Application, Application No. 2005800463657, issued Mar. 2, 2010.
Fourth Office Action issued in corresponding Chinese Patent Application, Application No. 2005800463657, issued Aug. 6, 2010.

International Search Report dated Feb. 14, 2006.

* cited by examiner

IMPACT-ATTENUATING ELEMENTS REMOVABLY MOUNTED IN FOOTWEAR OR OTHER PRODUCTS

CROSS-REFERENCE TO RELATED APPLICATION

This Non-Provisional U.S. Patent Application is a divisional application of and claims priority to U.S. patent application Ser. No. 10/997,981 (now abandoned), which was filed in the U.S. Patent and Trademark Office on Nov. 29, 2004 and entitled "Impact-Attenuating Elements Removably Mounted in Footwear or Other Products." This patent application is entirely incorporated herein by reference.

FIELD OF THE INVENTION

The invention relates generally to impact-attenuating elements, products containing them, and methods of using them. Such elements may be provided in a wide variety of different products, e.g., in footwear products or other foot-receiving devices, such as in the heel and/or toe areas of footwear products.

BACKGROUND

Conventional articles of athletic footwear have included two primary elements, namely, an upper member and a sole member structure. The upper member provides at least a partial covering for the foot that securely receives and positions the foot with respect to the sole structure. In addition, the upper member may have structures and a configuration that protect the foot and provide ventilation, thereby cooling the foot and removing perspiration. The sole structure generally is secured to a lower portion of the upper member and generally is positioned between the foot and the ground. In addition to attenuating ground reaction forces (i.e., imparting cushioning), the sole structure may provide traction and help control foot motions, such as pronation. Accordingly, the upper member and the sole structure operate cooperatively to provide a comfortable structure that is suited for a variety of ambulatory activities, such as walking and running.

The sole member or structure of athletic footwear generally has exhibited a layered configuration that includes a comfort-enhancing insole, a resilient midsole (e.g., formed from a polymer foam material), and a ground-contacting outsole that provides both abrasion-resistance and traction. The midsole typically is the primary sole structure element that attenuates ground reaction forces and controls foot motions. Suitable polymer foam materials for the midsole include ethylvinylacetate or polyurethane that compress resiliently under an applied load to attenuate ground reaction forces. Conventional polymer foam materials are resiliently compressible, in part, due to the inclusion of a plurality of open or closed cells that define an inner volume substantially displaced by gas.

As noted above, various ground reaction force attenuating elements and systems have been known, including such elements and systems for use in footwear products including athletic footwear products. Conventionally, the structure, feel, and characteristics of such elements and systems are selected by a footwear manufacturer, and these elements and systems (as well as their associated characteristics) are permanently fixed in the footwear products once the footwear products are made. Each individual footwear user, however, possesses unique characteristics that affect their physical fitness or training regimes, such as weight, foot size, type of workout or exercise performed, stride or gait characteristics (e.g., a pronation or supination tendency), personal tastes and preferences, etc. Therefore, this "one size fits all" approach to footwear design and production can lead to uncomfortable fits and/or limited sales due to the failure of the footwear products to match the conditions or characteristics desired and/or preferred by users.

Accordingly, it would be useful to provide footwear products or other foot-receiving devices that are readily customizable to a user's tastes and specifications, e.g., based on the user's immediate needs and/or the characteristics he/she desires in the footwear product or other foot-receiving device in general and/or at a given time.

SUMMARY

The following presents a general summary of aspects of the invention in order to provide a basic understanding of at least some aspects of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of this invention relate to impact-attenuating elements and products in which they are used (such as footwear, other foot-receiving devices, and the like). Impact-attenuating elements in accordance with at least some example aspects of this invention may include, for example: (a) a first base member; (b) optionally a second base member; and (c) a plurality of impact-attenuating members. The impact-attenuating members may be engaged with the first and/or second base members to provide an integral structure and/or they may be at least partially provided between the first and second base members. At least one of the first base member, the second base member, and/or the impact-attenuating members may include a means for releasably securing the impact-attenuating element to a foot-receiving device (e.g., to an upper member, a sole member, and/or the like).

Impact-attenuating elements, e.g., of the type described above, may be included in pieces of footwear and/or other foot-receiving devices (e.g., athletic shoes) in accordance with additional aspects of this invention. Such pieces of footwear or foot-receiving devices may include, inter alia: (a) an upper member; (b) a sole member engaged (directly or indirectly) with the upper member (e.g., at least in a toe area); and (c) an impact-attenuating element included as part of the sole member and/or the upper member and/or provided between the upper member and at least a portion of the sole member (e.g., at least in the heel area). In at least some examples, the impact-attenuating element may be attached to or included as a part of at least one of the upper member or the sole member. The impact-attenuating element may include a plurality of impact-attenuating members and a means for releasably securing the impact-attenuating element to at least one of a portion of the upper member or a portion of the sole member.

Additional aspects of this invention relate to methods for including impact-attenuating elements in products, such as in pieces of footwear or other foot-receiving devices. Such methods may include, for example: (a) providing an upper member and a sole member of a foot-receiving device; and (b) releasably engaging an impact-attenuating element with at least one of the upper member or the sole member. The impact-attenuating element may include a plurality of impact-attenuating members and a means for releasably securing the impact-attenuating element to at least one of a portion of the upper member or a portion of the sole member.

In at least some examples of the invention, the impact-attenuating element will be releasably engaged at a heel area of the foot-receiving device, although it may be engaged in other areas without departing from the invention.

BRIEF DESCRIPTION OF THE DRAWINGS

A more complete understanding of the present invention and certain advantages thereof may be acquired by referring to the following description in consideration with the accompanying drawings, in which like reference numbers indicate like features, and wherein.

DETAILED DESCRIPTION

Figure 1A:
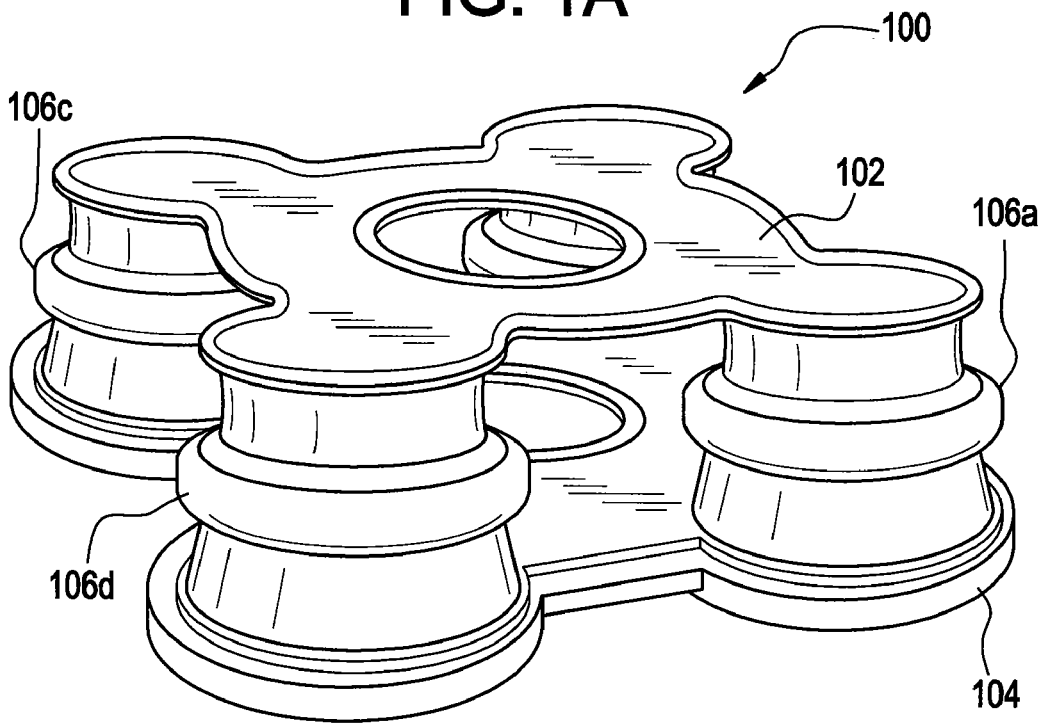
FIGS. 1A and 1B provide perspective views of an example impact-attenuating element in accordance with one example of this invention.

In the following description of various examples of the invention, reference is made to the accompanying drawings, which form a part hereof, and in which are shown by way of illustration various example systems and environments in which the invention may be practiced. It is to be understood that other specific arrangements of parts, example systems, and environments may be utilized, and that structural and functional modifications may be made without departing from the scope of the present invention. Also, while the terms "top," "bottom," "side," "front," "rear," and the like may be used in this specification to describe various example features and elements of the invention, these terms are used herein as a matter of convenience, e.g., based on the example orientations shown in the figures. Nothing in this specification should be construed as requiring a specific three dimensional orientation of structures in order to fall within the scope of this invention.

To assist the reader, this specification is broken into various subsections, as follows: Terms; General Description of Impact-Attenuating Elements According to Examples of the Invention; Specific Examples of the Invention; and Conclusion.

A. TERMS

The following terms are used in this specification, and unless otherwise noted or clear from the context, these terms have the meanings provided below.

"Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like.

"Footwear" means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, etc.), and the like.

B. GENERAL DESCRIPTION OF IMPACT-ATTENUATING ELEMENTS ACCORDING TO EXAMPLES OF THE INVENTION

In general, aspects of this invention relate to impact-attenuating elements, products in which they are used (such as footwear, other foot-receiving devices, and the like), and methods for including them in footwear, foot-receiving devices, and the like. Impact-attenuating elements in accordance with at least some example aspects of this invention may include, for example: (a) a first base member; (b) optionally a second base member; and (c) a plurality of impact-attenuating members. The impact-attenuating members may be engaged with the first and/or second base members to form an integral structure and/or may be provided at least partially between the first and second base members (when two base members are present). At least one of the first base member, the second base member, and/or the impact-attenuating members may include a means for releasably securing the impact-attenuating element to a foot-receiving device. In at least some examples of the invention, both the first base member and the second base member will include means for releasably securing the impact-attenuating element to a portion of a foot-receiving device, and optionally, in at least some instances, these means will act and function separately and independently from one another. Optionally, if desired, the two means for releasably securing, when two are present, also may structurally differ from one another.

The "means for releasably securing" the impact-attenuating element to another portion of the foot-receiving device structure (e.g., to a portion of the sole member, the upper member, etc.) may take on any desired structure without departing from the invention. For example, the "means for releasably securing" may include: one or more threaded fastener arrangements; one or more hook-and-loop fastener arrangements (e.g., a portion adhesively attached to the impact-attenuating element and a portion adhesively attached to the foot-receiving device (e.g., to a portion of the upper member or sole member)); one or more securing strap arrangements (e.g., attachable to the impact-attenuating element and the foot-receiving device (e.g., to a portion of the upper member or sole member) via snaps, buttons, retaining elements, or other connectors); one or more snap fastener arrangements; one or more turnbuckle fastener arrangements; one or more tab/retaining element type fastener arrangements; one or more raised rib/retaining element type fastening arrangements; and the like.

Additional aspects of this invention relate to pieces of footwear or other foot-receiving devices that include impact-attenuating elements (e.g., athletic shoes). More specifically, such pieces of footwear or other foot-receiving devices may include, inter alia: (a) an upper member; (b) a sole member engaged (directly or indirectly) with the upper member; and (c) an impact-attenuating element provided between the upper member and at least a portion of the sole member and/or engaged (directly or indirectly) with at least one of the upper member or the sole member. The impact-attenuating element may include a plurality of impact-attenuating members and a means for releasably securing the impact-attenuating element to at least one of a portion of the upper member or a portion of the sole member. The impact-attenuating element may be of the general types described above.

In at least some examples of the invention, the sole member may be engaged at a toe area of the foot-receiving device and the impact-attenuating element may be engaged at a heel area of the foot-receiving device. Optionally, in some examples, the sole member (e.g., an outsole portion of the sole member) may cover at least a portion of the impact-attenuating element. In still other examples, an exterior surface of the impact-attenuating element may be formed from a suitable material and/or include one or more traction elements so as to function as at least a portion of an outsole for the footwear or other foot-receiving device. As still other examples, impact-attenuating elements of the type described above may be provided in the toe area, and/or in any other desired location in the foot-receiving device without departing from this invention.

In some example foot-receiving device structures according to the invention, an exterior portion of the impact-attenuating element will remain at least partially visible and exposed, even after assembly of the footwear or foot-receiving device is completed and/or while the footwear or foot-receiving device is in use. In other examples, however, if desired, the impact-attenuating element may be enclosed in the foot-receiving device structure without departing from the invention. Optionally, if desired, the foot-receiving device structure may allow access to the impact-attenuating element in such enclosed structures, e.g., for later removal, customization, etc., as described in more detail below.

Still additional aspects of the invention relate to methods for including one or more impact-attenuating elements in a piece of footwear or other foot-receiving device. Such methods may include, for example: (a) providing an upper member and a sole member of a foot-receiving device; and (b) releasably engaging an impact-attenuating element (directly or indirectly) with at least one of the upper member or the sole member. The impact-attenuating element may include a plurality of impact-attenuating members and a means for releasably securing the impact-attenuating element to at least one of the upper member or the sole member. In at least some examples of the invention, the impact-attenuating element will be releasably engaged at a heel area of the foot-receiving device, although it may be engaged in other areas, as described above, without departing from the invention.

The step of releasably engaging the impact-attenuating element with the upper member or the sole member may take place in any desired manner without departing from the invention. For example, it may include: engaging threaded regions provided on the various elements; engaging a hook-and-loop fastener arrangement; engaging a securing strap arrangement; engaging buttons, snaps, or other retaining devices; engaging a turnbuckle fastener arrangement; engaging one or more tabs around a retaining element; engaging a retaining element around a raised rib; inserting a tab member through a recess and retaining it against a retaining element; and the like. The impact-attenuating element may be of the types described above (and described in more detail below).

Additional aspects of the invention relate to the ability for users (or others) to freely and selectively interchange one impact-attenuating element for another, e.g., to customize the foot-receiving device for a specific user's characteristics and/or for specific use characteristics. Thus, in accordance with at least some aspects of the invention, a user may disengage one impact-attenuating element from a foot-receiving device and releasably engage another impact-attenuating element with it. The new impact-attenuating element may be of the same structure and other characteristics as the one removed, or it may have a different structure or other characteristics. As more specific examples, the impact-attenuating element may be selected based on one or more characteristics of the intended end user, such as: the user's weight, the user's shoe size, the user's foot width, the user's moving speed or anticipated moving speed, the user's typical stride or gait (e.g., a pronation or supination tendency, etc.), and the like. Also, different impact-attenuating elements may be selected depending on the final intended end use of the footwear or foot-receiving device products. For example, different impact-attenuating elements may be selected depending on whether the user intends to use the product for walking, running, basketball, soccer, football, baseball, softball, sprinting, track events, field events, cross-training, children's games, video games, etc. A user also may select different impact-attenuating elements based on their particular preferences, such as comfort, feel, etc. Further, if desired, one shoe of a pair may have an impact-attenuating element of different characteristics as compared to the other shoe of the pair.

The impact-attenuating elements also may be selected and/or included as part of the footwear or other foot-receiving device structure at any desired location and/or point in the distribution chain without departing from the invention. For example, the impact-attenuating elements may be selected at the assembly factory and the products then may be marketed in a manner targeted to specific intended users or use characteristics (e.g., the sales box or a tag on the product might indicate that the shoe is designed for running or jogging for a user between 165 and 180 lbs.). As another example, shoe retailers or wholesalers may have a supply of impact-attenuating elements available to insert into the footwear or other foot-receiving device at the point of sale and/or a shipping location, e.g., based on the characteristics of the intended user and/or the intended use, to replenish depleted stock, etc. As still another example, users may be allowed to freely select and/or change impact-attenuating elements based on their immediate needs or the characteristics they desire in the footwear or other foot-receiving device at a given time (e.g., by switching one impact-attenuating element for another at a point of use location, etc.).

Specific examples of the invention are described in more detail below. The reader should understand that these specific examples are set forth merely to illustrate examples of the invention, and they should not be construed as limiting the invention.

C. SPECIFIC EXAMPLES OF THE INVENTION

The various figures in this application illustrate examples of impact-attenuating elements useful in systems and methods according to examples of this invention. When the same reference number appears in more than one drawing, that reference number is used consistently in this specification and the drawings to refer to the same part throughout.

Figure 1B:
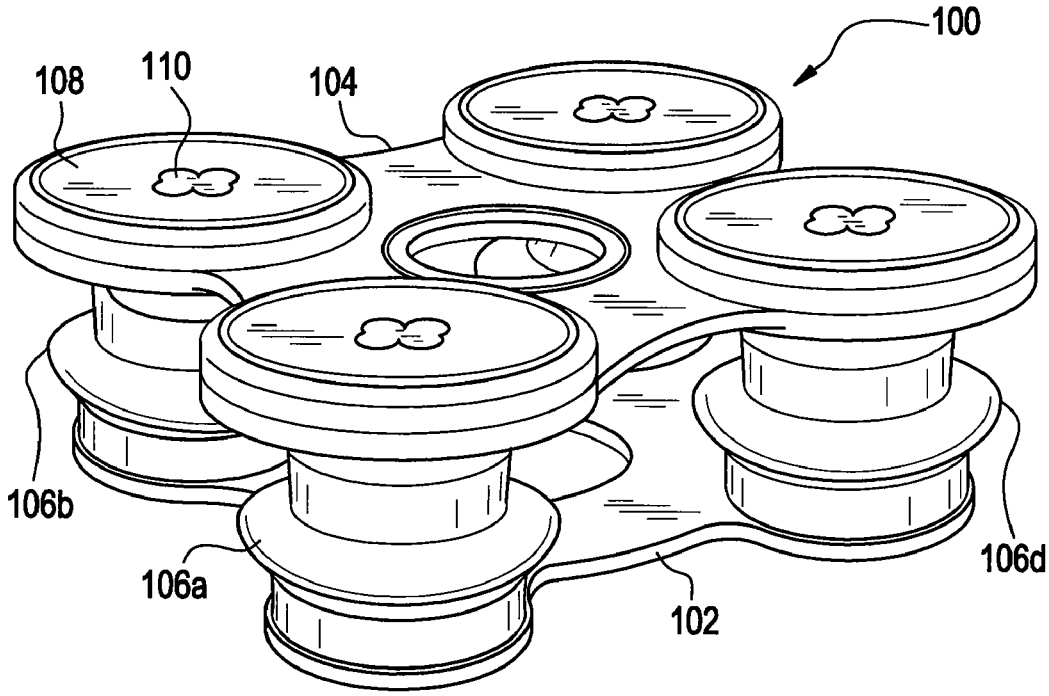

FIGS. 1A and 1B illustrate perspective views of a first example impact-attenuating element 100 in accordance with this invention. As illustrated, this example impact-attenuating element 100 includes a first base member 102 located at the top of the element 100 when placed in a foot-receiving device and a second base member 104 located at the bottom of the element 100 when placed in a foot-receiving device. Plural impact-attenuating members 106*a* through 106*d* are arranged between the first base member 102 and the second base member 104. The plural impact-attenuating members 106*a* through 106*d* may be held together with the base members 102 and 104 in any desired manner to form an integral construction without departing from the invention, such as via adhesives, friction fit, mechanical connectors (e.g., clips, snaps, other retaining elements, etc.), optionally releasable mechanical connectors, integrally formed by molding, etc., and/or the like. In at least some examples of the invention, the impact-attenuating element 100 will form an integral construction for placement in the heel area of a piece of footwear or other foot-receiving device (e.g., also called an "impact-attenuating puck" or a "heel cage" member).

Any desired impact-attenuating members 106*a* through 106*d* may be used without departing from the invention. In at least some examples, the impact-attenuating members 106*a* through 106*d* may include springs, mechanical impact-attenuating devices, and the like. In some examples, the impact-attenuating members 106*a* through 106*d* may be of the type used in SHOX® footwear products commercially available from NIKE, Inc., of Beaverton, Oreg. Also, any desired materials may be used for the base members 102 and 104 without departing from the invention, such as metals, polymeric materials, and the like, including conventional materials known and used in the art.

If desired, in at least some example structures in accordance with the invention, at least an exterior surface 108 or exterior layer(s) of the bottom base member 104 and/or the impact-attenuating members 106*a* through 106*d* may be made of suitable materials and/or may be formed to include tread elements 110 and/or other structures that allow the exterior surface 108 to function as at least a portion of an outsole member for the piece of footwear or other foot-receiving device in which it is mounted. The exterior surface 108 and/or tread elements 110 may be made from any desired material(s) and/or in any desired shape(s) or construction(s) without departing from the invention, including from conventional materials and/or with conventionally shaped tread elements and/or constructions as are known in the art. In at least some examples of the invention, the exterior surface 108 and the tread elements 110 may be made from materials and formed in a manner the same as or similar to those used in known SHOX® footwear products commercially available from NIKE, Inc., of Beaverton, Oreg.

Impact-attenuating elements 100 of the type illustrated in FIGS. 1A and 1B may be releasably or removably mounted in a foot-receiving device, such as in a piece of athletic footwear. The elements 100 may be formed as a secure, cohesive assemblage of parts such that the upper base member 102 and/or the lower base member 104 provide suitable bases for securing the impact-attenuating element 100 to foot-receiving device. Moreover, the base members 102 and/or 104 provided as part of the impact-attenuating element 100 may eliminate the need for plate material as part of the foot-receiving device structure (e.g., eliminate the need for heel plates in the upper member and/or the sole member of the foot-receiving device structure). The integral, one piece assembly of the impact-attenuating elements 100 according to this example of the invention makes assembly of the foot-receiving device easier, as the entire element 100 may be inserted into the foot-receiving device structure as a single piece, eliminating the difficulty in assembling and aligning several relatively small pieces during manufacturing.

Figure 2:
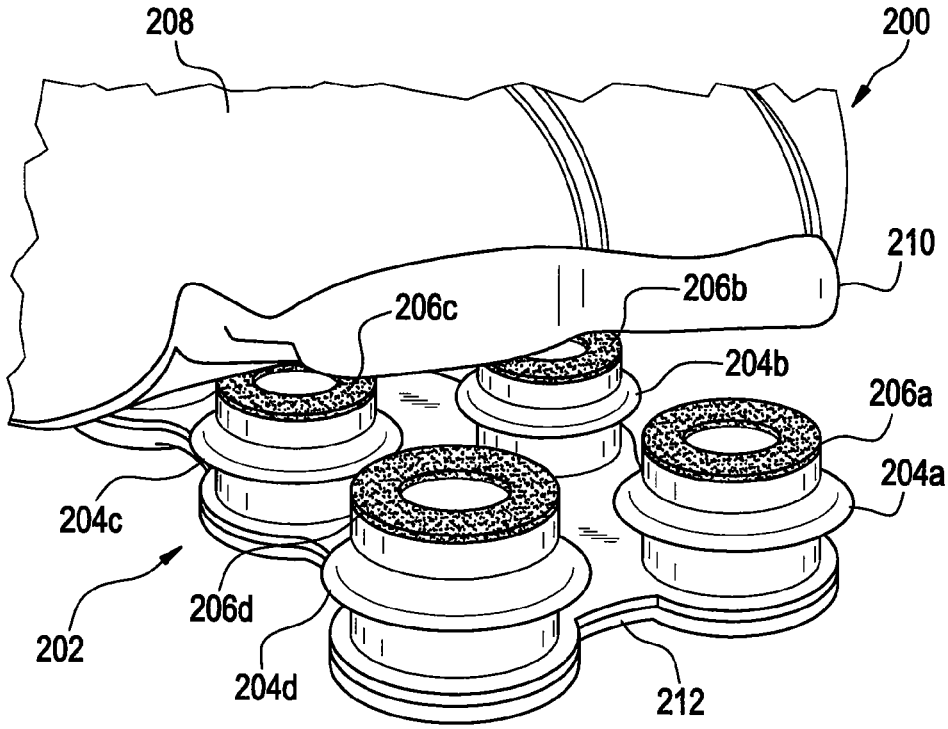
FIGS. 2 through 8 illustrate various examples of structures used for releasably securing an impact-attenuating element to a foot-receiving device.

Various ways of releasably and/or removably attaching one or more impact-attenuating elements, e.g., elements 100, to a foot-receiving device may be used in accordance with examples of this invention. FIG. 2 illustrates a portion of one example foot-receiving device structure 200 in the form of an athletic shoe wherein an impact-attenuating element 202 is provided in the heel area of the shoe 200. In the example structure shown in FIG. 2, the top of each impact-attenuating member 204*a* through 204*d* includes a portion of a hook-and-loop type fastener element 206*a* through 206*d*. These portions of the hook-and-loop fastener elements 206*a* through 206*d* releasably engage corresponding hook-and-loop fastener elements provided on the midsole 210 (or on the insole or the upper members 208) of the foot-receiving device structure 200. If desired, additional securing means may be provided to help further secure the impact-attenuating element 202 to the remainder of the foot-receiving device structure 200. Examples of potential additional securing means will be described in more detail below.

As illustrated in FIG. 2, it is not necessary for impact-attenuating elements in accordance with all examples of the invention to include a top base member and/or a bottom base member like those illustrated in FIGS. 1A and 1B. For example, as shown in FIG. 2, a bottom base member 212 is provided (e.g., made of a material suitable for use as an outsole and/or including traction elements in this example), but the top ends of the impact-attenuating members 204*a* through 204*d* remain free and are not connected to one another through a base member. Of course, if desired, an additional top base member and/or a separate outsole member may be provided without departing from the invention. As another example, if desired, one or more centrally located webs or base members may be provided between the top and bottom of the impact-attenuating members 204*a* through 204*d* to hold the overall impact-attenuating element 202 together as an integral structure. As still another example, if desired, a central impact-attenuating member may be provided between the four illustrated impact-attenuating members 204*a* through 204*d*, wherein a top, bottom, or side surface of the central impact-attenuating member engages and connects with corresponding top, bottom, or side surface of the remaining impact-attenuating members 204*a* through 204*d* to thereby hold the overall impact-attenuating element 202 together as an integral structure. Other ways of holding the overall impact-attenuating element 202 structure together may be used without departing from the invention.

Figure 3:
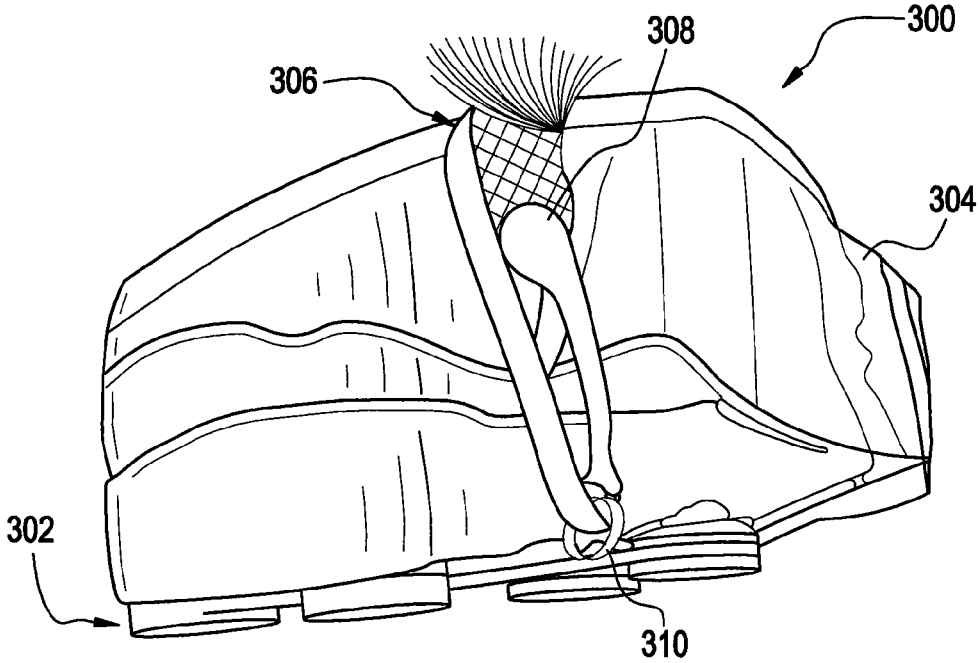

FIG. 3 illustrates another example of a mechanical connecting system that may be used, at least in part, to secure an impact-attenuating element 302 to the remainder of a piece of footwear or other foot-receiving device 300. In this example foot-receiving device structure 300, the impact-attenuating element 302 is fixed to the upper member 304 (or, if desired, to a portion of the sole structure, such as the midsole or insole) via a securing strap element 306. More specifically, in this illustrated example, one end of the securing strap element 306 attaches to or through a connection point 310, e.g., provided as part of the impact-attenuating element structure 302, and a second end of the securing strap element 306 engages (e.g., hooks around, passes through, etc.) a connection point 308 provided on the upper member 304 or on another part of the overall foot-receiving device structure 300 (e.g., optionally, if desired, connection point 308 may be provided on a portion of the sole structure (e.g., the midsole, etc.)).

Optionally, if desired, more than one securing strap arrangement may be present in the overall structure 300 without departing from the invention (e.g., one or more on each side of the device 300, one or more at the back of the heel, etc.). As another alternative or option, a single securing strap 306 may be provided that extends from a connection point 308 on one side of the foot-receiving device structure 300 (e.g., from the upper member or sole member), around the bottom of the impact-attenuating element 302, and around to a connection point 308 on the opposite side of the foot-receiving device structure 300 (e.g., to the upper member or sole member). Optionally, if desired, such a securing strap 306 also may be secured to a member provided on the impact-attenuating element 302 structure, such as through one or more openings or retaining elements provided as part of the impact-attenuating element 302. Additionally or alternatively, if desired, the securing strap 306 may extend through a recess or groove formed in the bottom of the impact-attenuating element structure 302 and/or in the bottom of the outsole member (if any) so that the securing strap 306 or parts thereof do not directly contact the ground surface in use. As still another alternative, the securing strap 306 may fit through or engage a ring or loop or other attachment element or opening provided in the impact-attenuating element 302, the outsole member, and/or other portion of the foot-receiving device structure 300.

FIG. 3 illustrates an additional example feature according to at least some examples of the invention. Particularly, as shown, the entire impact-attenuating element 302 (e.g., each impact-attenuating member or column) need not be exposed in the final foot-receiving device structure 300. Rather, if desired, the impact-attenuating element 302 may fit within a recess provided in the sole structure 310 such that at least the side and top surfaces of the impact-attenuating element 302 are hidden from view in the final assembly and in use. As another alternative, the impact-attenuating element itself may include side surfaces that hide the impact-attenuating members and/or columns in use. Also, if desired, a portion of the outsole may cover the impact-attenuating member in at least some examples of the invention.

Figure 4:
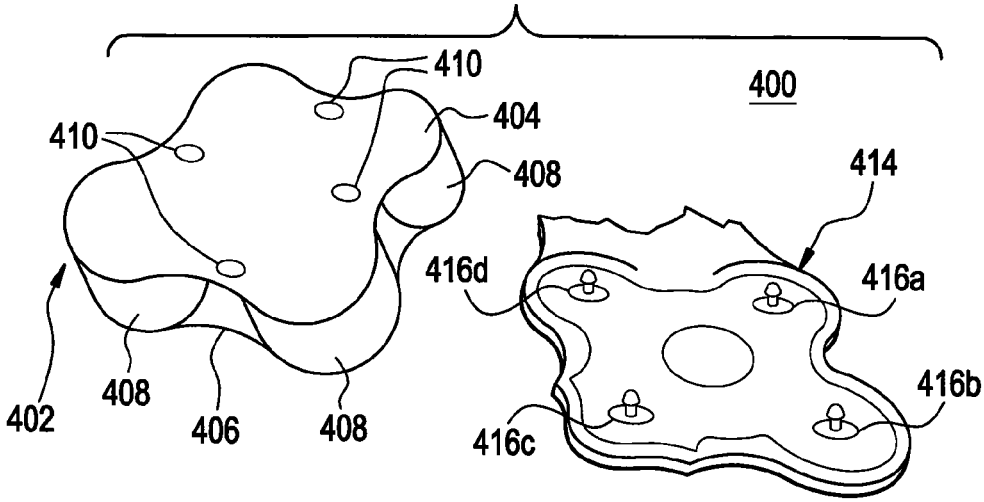

In at least some example structures according to this invention, the impact-attenuating element will include bottom base surfaces (or at least portions thereof) that are not designed to directly engage the ground in use. FIG. 4 illustrates an example of the heel portion 400 of a foot-receiving device structure of this type. Specifically, the impact-attenuating element 402 of this example structure includes a top surface 404, a bottom surface 406, and plural impact-attenuating members 408 located between the top and bottom surfaces 404 and 406, respectively. The top surface 404 includes plural female "snap" type fastener elements 410 that removably and releasably engage with male "snap" type fastener elements (e.g., of the type shown at reference number 416*a* through 416*d*) provided on the remaining structure of the foot-receiving device (while the remaining structure is not shown in FIG. 4, such male "snap" type fastener elements may be provided on the upper member, on a portion of the sole structure (e.g., the midsole or insole), or the like).

In this example arrangement 400, the impact-attenuating element 402 further may be secured to the remainder of the foot-receiving device structure by an outsole flap 414 that includes male "snap" type fastener elements 416*a* through 416*d* that releasably and removably engage female "snap" type fastener elements provided on the exterior surface of the bottom base member 406 (these female snap elements are not shown in FIG. 4). The outsole flap 414 may be integrally formed as part of the overall outsole structure of the piece of footwear or other foot-receiving device, it may be attached to the piece of footwear or other foot-receiving device (e.g., via adhesive, molding, mechanical connections, one or more shafts, etc.) or the like. In this illustrated example, the exterior surface of the bottom base member 406 is not designed to contact the ground in use (and does not include traction elements or the like), but rather the exterior surface of the outsole flap 414 (not shown in FIG. 4), is made from a material and/or includes traction elements so as to be designed to directly contact and engage the ground (or other surface) in use.

Figure 5:
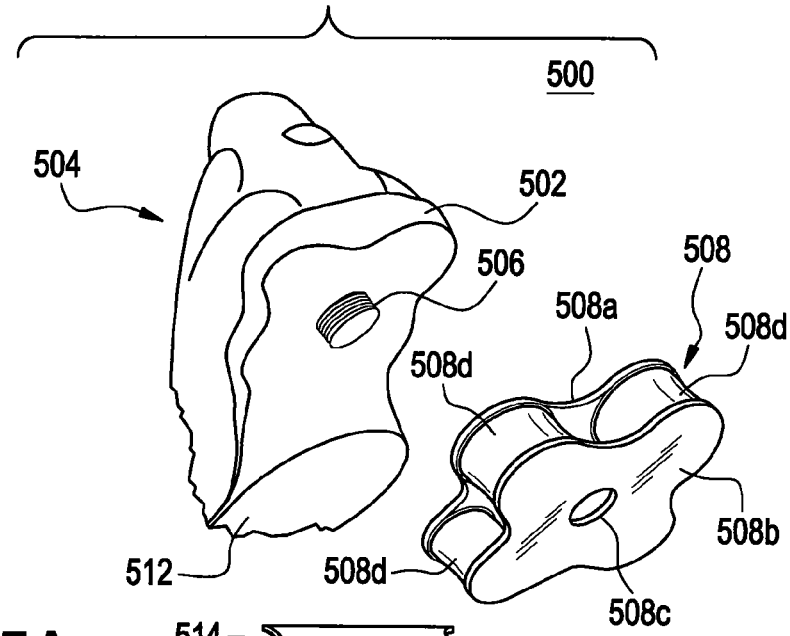

FIG. 5 illustrates an exploded view of an example footwear structure 500 according to this invention. In this example structure 500, a midsole or insole 502 (or other portion) of a piece of footwear 504 includes a mounting member 506 (e.g., a threaded mounting member akin to a bolt in this example). The impact-attenuating element 508 engages the mounting member 506, e.g., by fitting over it and around it. Optionally, in at least some examples, the top base member 508*a* of the impact-attenuating element 508 may include a region (e.g., a threaded region akin to a nut) that releasably and removably engages the threads of the mounting member 506. As another example, the top base member 508*a* simply may include an opening defined therein and the bottom base member 508*b* also may include an opening 508*c* defined therein, and the mounting member 506 may extend at least partially through one or more of these openings, optionally to engage a retaining member (e.g., a separate retaining member have a threaded region akin to a nut, a threaded member integrally provided with the outsole, etc.). As still another example, a threaded member that engages the mounting member 506 may be provided as part of the bottom base member 508*b*.

FIG. 5 further illustrates an outsole flap member 510 that may be included as an integral structure with and/or attached to the outsole 512 of the remainder of the footwear structure. More specifically, the extending flap 514 of the flap member 510 in this example structure may be integrally formed with, may extend from, and/or otherwise may be attached to the foot-retaining device, e.g., at or near the footwear outsole 512. The impact-attenuating member 508 then may be sandwiched between the midsole structure 502 and the outsole flap 510 and removably secured between these structures 502 and 510, e.g., via threaded engagement between the mounting member 506 and a retaining element (e.g., a nut/washer combination or similar type assembly provided on outsole flap member 510). Rather than a threaded engagement, a turnbuckle type arrangement and/or other securing means may be used without departing from the invention. A turnbuckle arrangement will be described in more detail below in connection with FIGS. 9A through 9C.

Figure 5A:
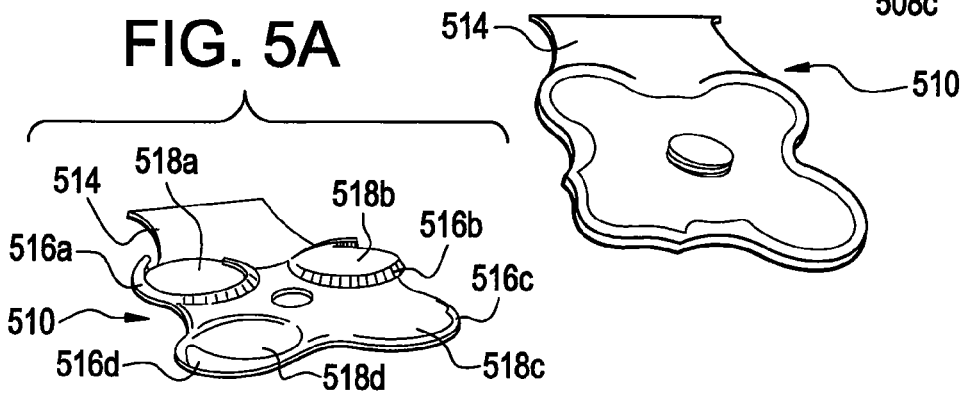

In this illustrated example, the outsole flap 510 completely covers the bottom surface 508*b* of the impact-attenuating element 508, and the exterior surface of the outsole flap 510 functions as a portion of the outsole of the piece of footwear 500. If desired, as illustrated in FIG. 5A, the outsole flap 510 may include raised outer lips 516*a* through 516*d* that define pockets 518*a* through 518*d* into which the various columns 508*d* (or surfaces in base member 508*b* corresponding to columns 508*d*) of the impact-attenuating element 508 may fit, to further help secure the impact-attenuating element 508 to the remainder of the foot-receiving device structure (e.g., for use if the bottom surface of base member 508*b* includes outlines of the columns 508*d* or if no base member 508*b* is included in the impact-attenuating element structure 508). Additionally or alternatively, the raised outer lips 516*a* through 516*d* along the outer edge of the outsole flap 510 may engage around, hold, and help retain the outer edge of the bottom base member 508*b* of the impact-attenuating element 508.

Figure 6:
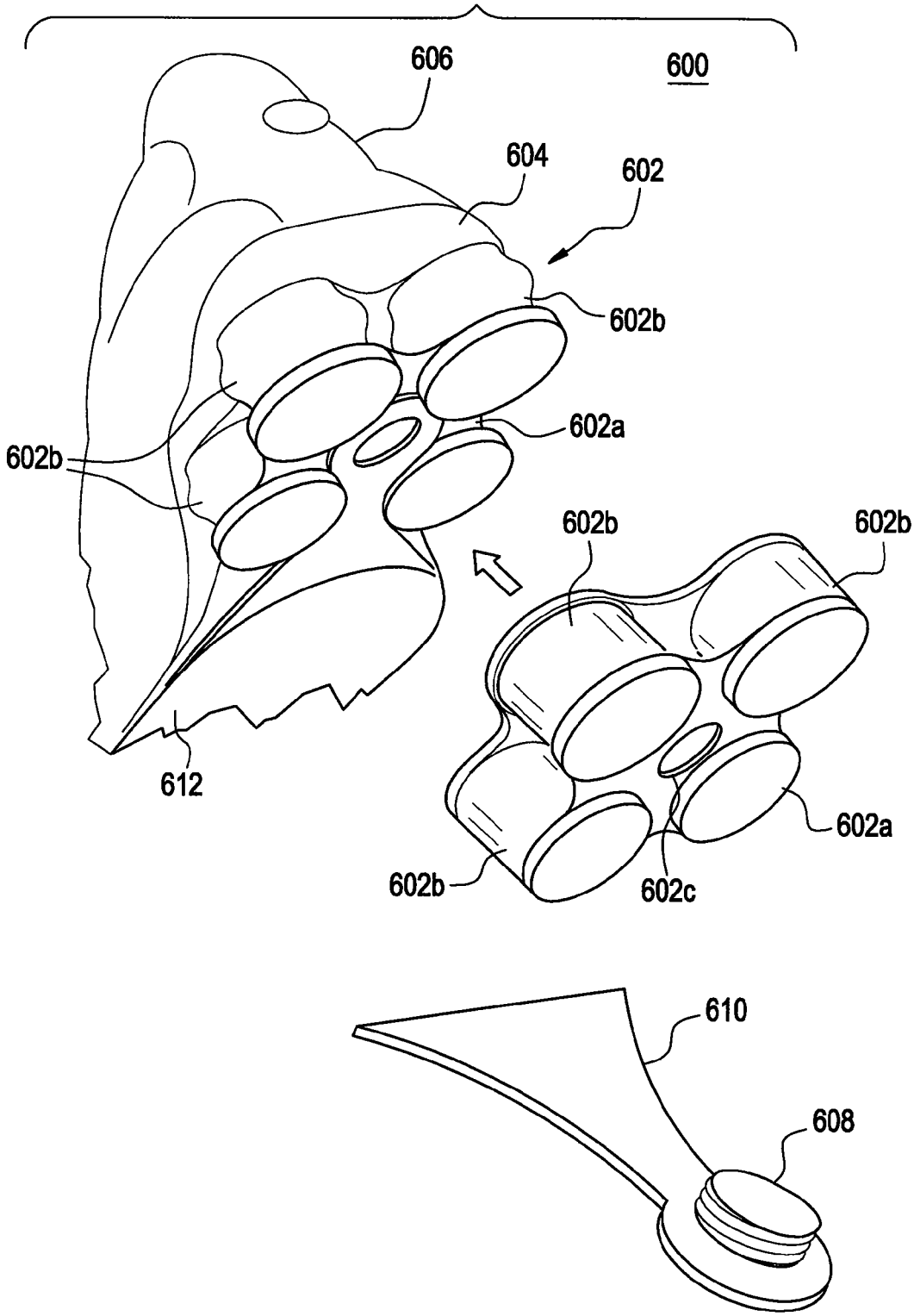

While one or more threaded engagements are described in conjunction with the structure of FIG. 5 (e.g., between a mounting member 506 and an outsole flap 510 (e.g., via a retaining element), between a mounting member 506 and the impact-attenuating element 508, between the impact-attenuating element 508 and the outsole flap 510, etc.), other ways of releasably and removably securing an impact-attenuating element to the remainder of a foot-receiving device structure may be used without departing from the invention. FIG. 6 illustrates another example of securing an impact-attenuating element 602 to the remainder of a foot-receiving device 600 structure. More specifically, in this example, like in the example illustrated in FIG. 5, the impact-attenuating element 602 is sandwiched between a midsole or insole 604 of the piece of footwear 600 (or optionally some portion of the upper member 606) and a retaining element 608 attached to and/or provided as part of an outsole flap 610. The outsole flap 610 may be integrally formed as part of the outsole 612 and/or may be attached to the outsole 612 (or other portion of the foot-receiving device structure 600), e.g., by adhesives, mechanical connections, molding, rotatable connections, etc. In this example structure, however, the bottom plate 602*a* of the impact-attenuating element 602 (or the bottoms of impact-attenuating members 602*b*) may be formed of a material and/or include traction elements so as to function as a portion of the outsole for the foot-receiving device structure 600. As illustrated in FIG. 6, the flap 610 is sized and shaped so as to fit between two adjacent impact-attenuating members 602*b* provided as part of the impact-attenuating element 602. In this manner, the outsole flap 610 and/or retaining element 608 will not directly contact the ground in use. Alternatively, if desired, a separate outsole plate (e.g., including traction elements) may be sandwiched between the impact-attenuating element 602 bottom surface 602*a* and the outsole flap 610.

Again, any manner of releasably engaging the impact-attenuating member 602 with the remainder of the foot-receiving device structure 600 and/or the outsole flap 610 may be used without departing from the invention. For example, a rotatable threaded retaining member 608 included as part of the flap 610 may engage a corresponding threaded member provided with the impact-attenuating member 602, and a threaded region on the impact-attenuating member 602 may engage a corresponding threaded member on the upper member 606, the midsole member 604, or the like. As another example, a threaded retaining member 608 included as part of the flap 610 may pass through opening 602*c* defined in the impact-attenuating member 602 and engage a corresponding threaded member on the upper member 606, the midsole member 604, or the like. Engaging systems other than threaded regions also may be used without departing from the invention, such as turnbuckles, hook-and-loop fasteners, snap fasteners, securing straps, and the like. Additionally, if desired, the system used for attaching the impact-attenuating element 602 to the upper member 606 or the midsole member 604 (or other structure, if any) may differ structurally and functionally from the system used for attaching the outsole flap 610 to the impact-attenuating member 602 without departing from the invention.

Figure 7:
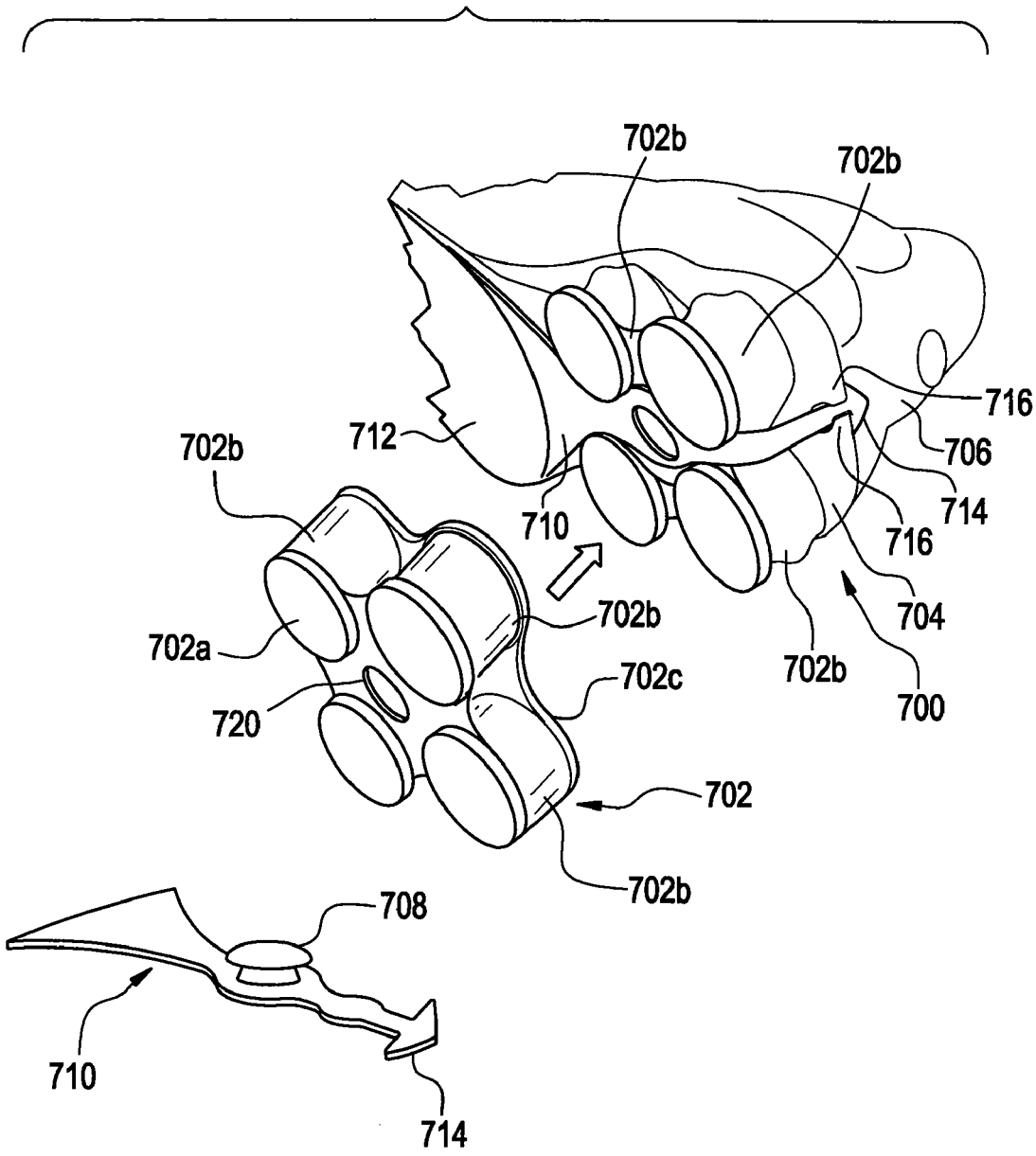

FIG. 7 illustrates a system similar to that shown in FIG. 6, but with a somewhat different type of outsole flap and retaining member. In this example foot-receiving device structure 700, an impact-attenuating element 702 is sandwiched between a midsole 704 of the piece of footwear 700 (or optionally some portion of the insole or upper member 706) and a retaining element 708 provided on an outsole flap 710. The outsole flap 710 may be integrally formed as part of the outsole 712 and/or may be attached to the outsole 712 (and/or to some other portion of the foot-receiving device structure 700), such as by adhesives, molding, mechanical connections, or the like. Like the example structure shown in FIG. 6, in this example structure 700, the bottom plate 702*a* of the impact-attenuating element 702 is formed of a material and/or includes traction elements so as to function as a portion of the outsole for the overall foot-receiving device structure 700. Also, as illustrated in FIG. 7, the flap 710 is sized and shaped so as to fit between the impact-attenuating members 702*b* provided as part of the impact-attenuating element 702. In this manner, the outsole flap 710 and/or retaining element 708 will not directly contact the ground in use. Alternatively, if desired, a separate outsole plate (e.g., including traction elements) may be sandwiched between the impact-attenuating element 702 and the outsole flap 710, and/or the outsole flap 710 may include traction elements and/or other structures for engaging the ground surface.

Again, any manner of releasably engaging the impact-attenuating member 702 with the remainder of the foot-receiving device structure 700 and/or the outsole flap 710 may be used without departing from the invention. For example, as illustrated in FIG. 7, a retaining plug member 708 on the flap 710 may engage a corresponding opening 720 defined in the bottom base member 702*a* of the impact-attenuating member 702, and the opening 720 may be sized and shaped so as to releasably retain the plug member 708 therein (e.g., by retaining the expanded head on plug 708 behind opening 720). If desired, a similar plug member may be provided on the midsole, insole, or upper member to engage a similar opening in the top base member 702*c*, if desired. Alternatively, a similar plug member may be provided on the top base member 702*c*, and it may engage an opening defined in the midsole, insole, or upper member, if desired. Also, if desired, a different structure and method for securing the impact-attenuating element 702 to the remainder of the foot-receiving device structure 700 may be used without departing from the invention, including the various releasable retaining structures and methods described above (such as threaded members, turnbuckles, hook-and-loop fasteners, snap fasteners, securing straps, and the like).

FIG. 7 illustrates another option, at least in part, for securing the impact-attenuating element 702 to the remainder of the foot-receiving device structure 700 that may be used in accordance with the invention. More specifically, in this example structure, the outsole flap 710 includes a retaining extension 714 that extends around the back of the impact-attenuating element 702 and engages retaining elements or tabs 716 provided in the back of the foot-receiving device structure 700 (e.g., provided in the midsole 704, heel counter, upper member 706, etc.). In at least some examples, at least a portion of the free end of the outsole flap 710 will be made from an elastomeric material such that it stretches around the impact-attenuating element 702 to the retaining tabs 716 to more firmly hold the impact-attenuating element 702 in place. If desired, in some examples of the invention, the retaining extension 714 and retaining tab 716 combination may be the sole or primary attachment of the impact-attenuating element 702 to the midsole 704, insole, and/or upper member 706 structure(s) (e.g., the retaining plug member 708 may be omitted, if desired).

Also, if desired, plural retaining extensions 714 and retaining tab 716 combinations may be provided without departing from the invention. For example, two or more such combinations may be provided at the back of the heel area of the shoe. As still another alternative, if desired, one or more retaining extensions 714 and retaining tab 716 combinations may be provided that extend around the lateral and/or medial sides of the heel area. Other locations for such combinations also may be used without departing from the invention.

Figure 8:
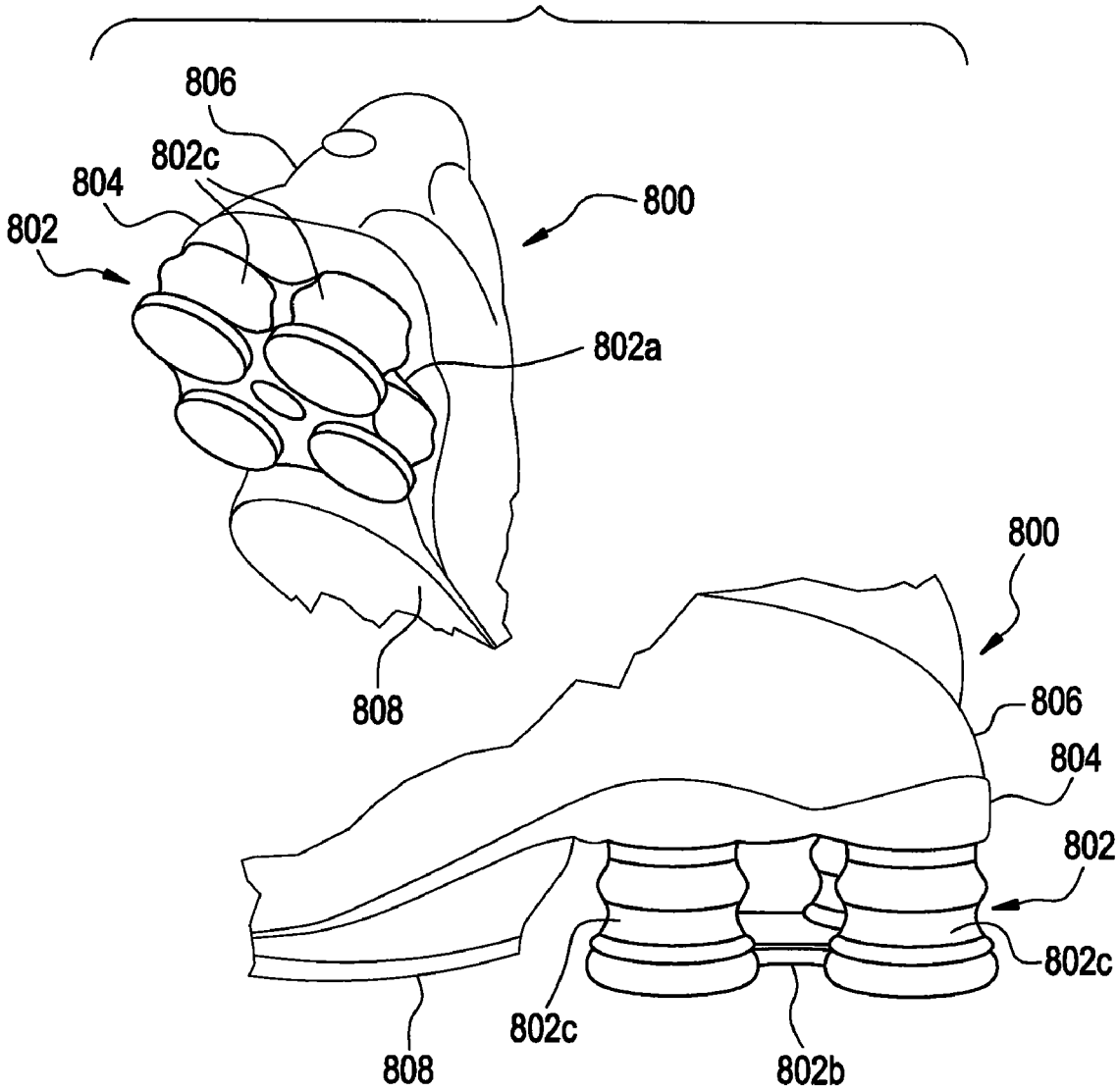

Another example structure that includes an impact-attenuating element releasably secured to the remainder of a foot-receiving device structure is illustrated in FIG. 8. In this example structure 800, the impact-attenuating device 802 is releasably secured to the midsole 804, insole (not shown), upper member 806, or other portion of the foot-receiving device structure 800 only at the top base member 802*a* of the impact-attenuating element 802. The bottom base member 802*b* of the impact-attenuating element 802, in this illustrated example, is made from materials and/or includes traction elements so as to be suitable to directly engage the ground or other surface during use of the foot-receiving device 800. Notably, this example structure 800 does not include any direct connection or engagement between the outsole 808 and the impact-attenuating element 802 (e.g., no retaining elements, straps, snaps, hook-and-loop fasteners, or the like). If desired, bottom base member 802*b* may be omitted and the bottoms of the impact-attenuating columns 802*c* may be constructed to directly engage the ground in use.

Of course, any manner of securing the impact-attenuating element 802 to the remainder of the foot-receiving device structure 800 (e.g., to the insole, midsole 804, and/or upper member 806) may be used without departing from the invention. For example, the various ways of attaching described above may be used, such as a plug member fitting in a retaining opening, threaded members, turnbuckles, hook-and-loop fasteners, snap fasteners, securing straps, and the like. A more detailed example of a turnbuckle type fastener arrangement that may be used in connection with the structure 800 of FIG. 8 (as well as the other structures described above) is described below in conjunction with FIGS. 9A through 9C.

Figure 9A:
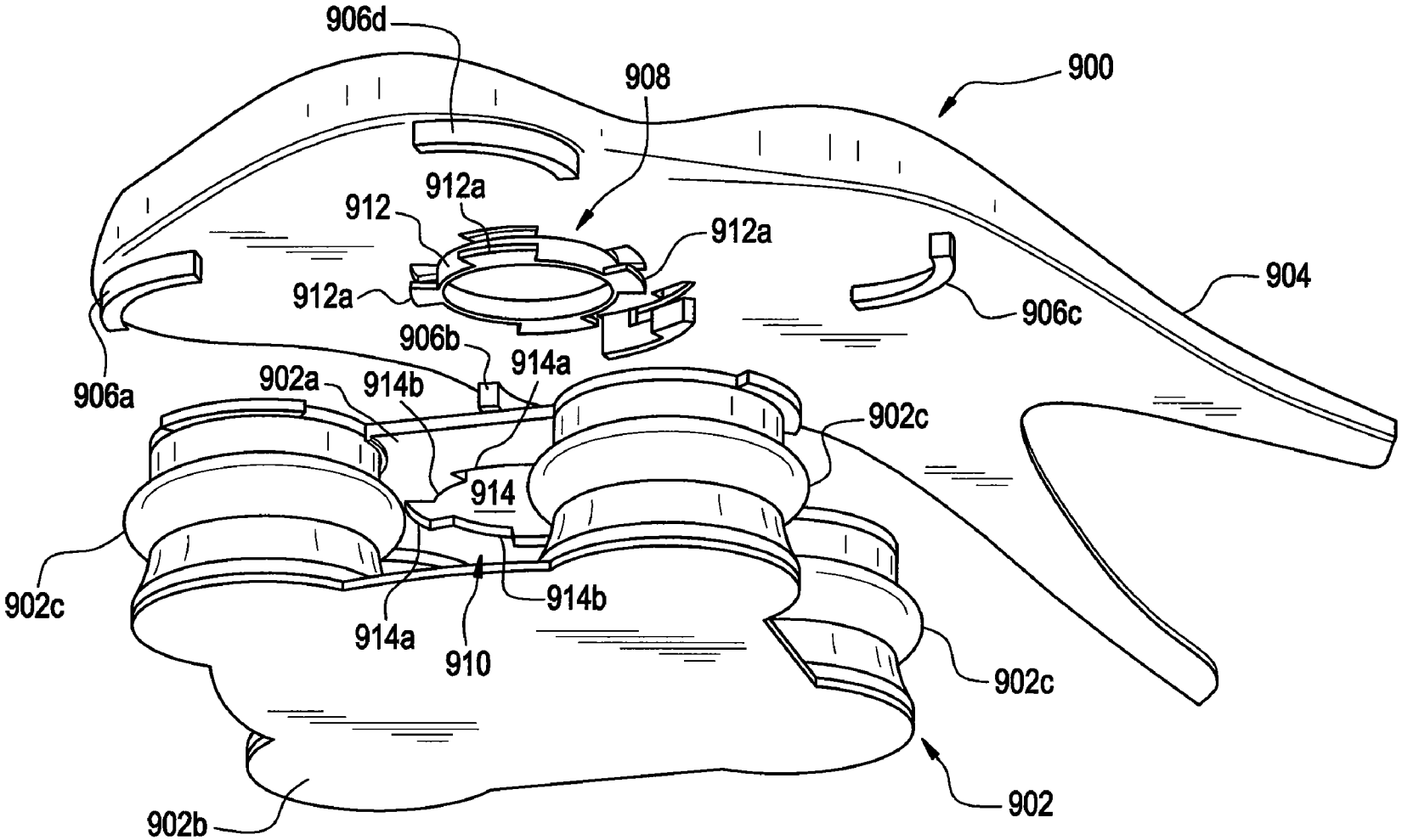
FIGS. 9A through 9C illustrate additional details of an example turnbuckle type system for releasably engaging an impact-attenuating element to a portion of a foot-receiving device.
Figure 9B:
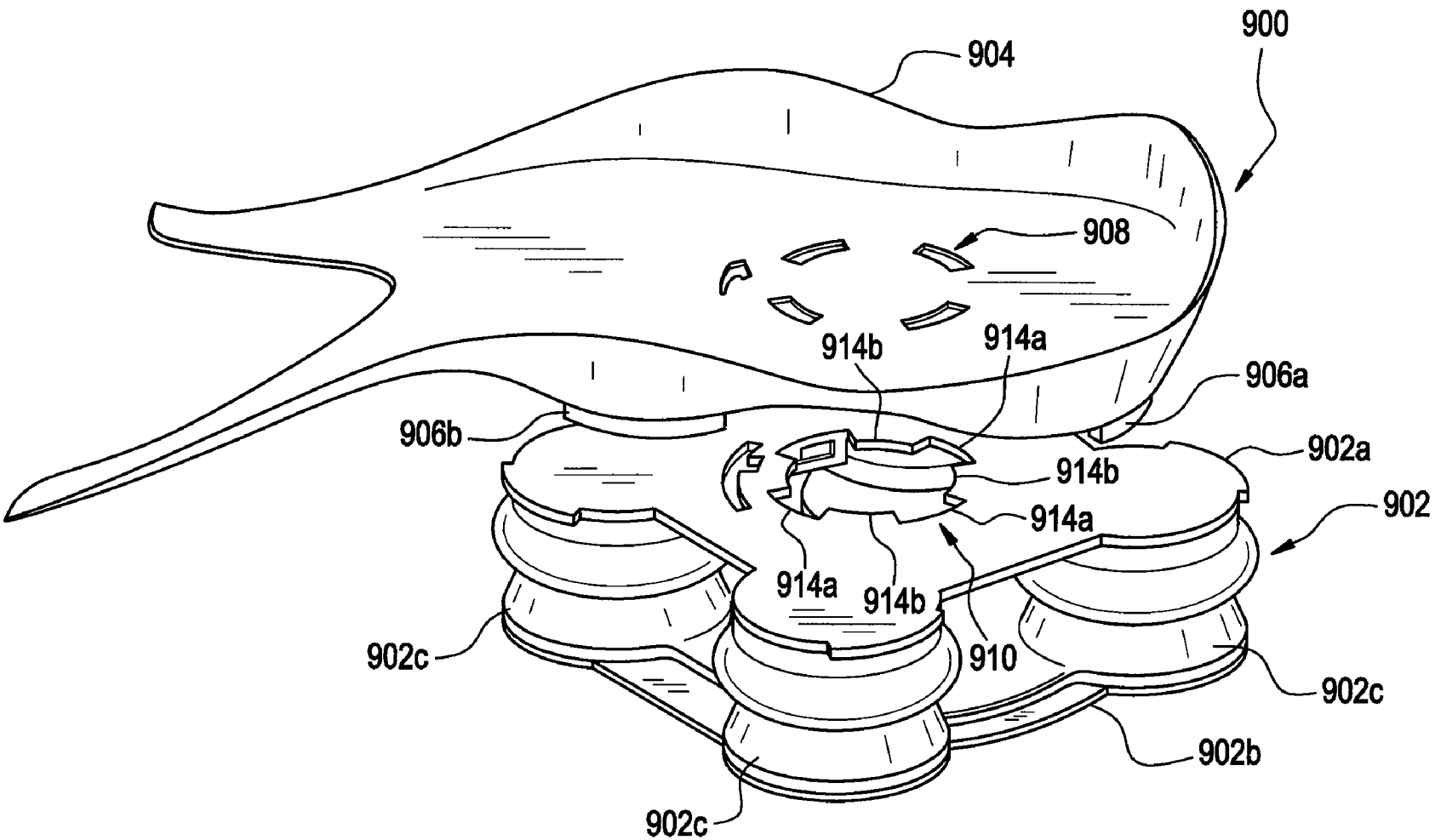
Figure 9C:
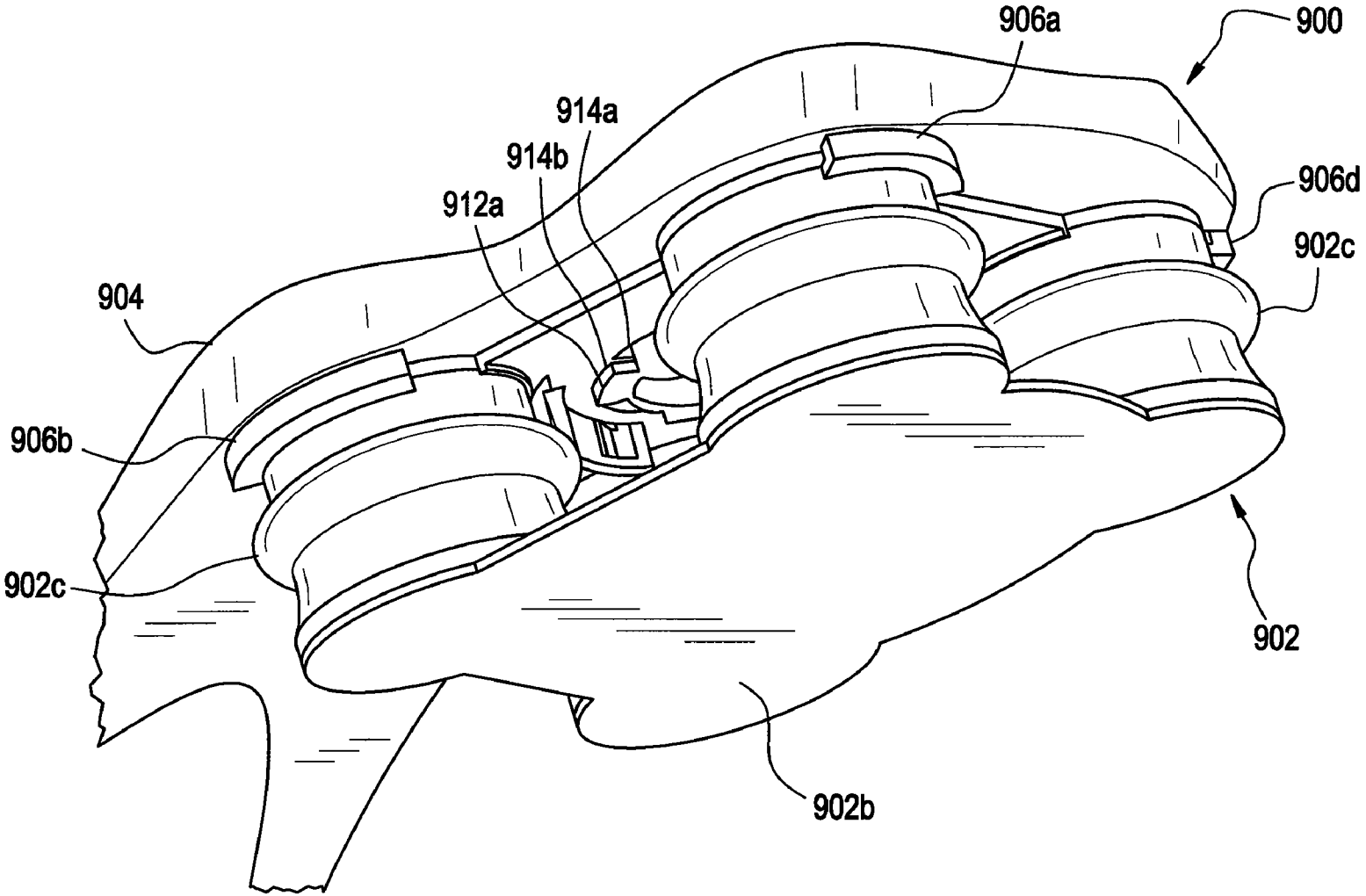

FIGS. 9A through 9C illustrate an example "turnbuckle-type" structure that may be used to secure an impact-attenuating element to another portion of a foot-receiving device structure, such as an insole, midsole, outsole, and/or upper member. As illustrated, the overall structure 900 includes an impact-attenuating element 902 and another portion of the foot-receiving device to which it is attached (in this illustrated example, the impact-attenuating element 902 is attached to a portion of a footwear midsole 904). In this example, the midsole member 904 includes outer retaining lips 906*a* through 906*d* that help retain the impact-attenuating element 902 in place with respect to the midsole member 904, although such retaining lips 906*a* through 906*d* may be omitted without departing from the invention. A central portion of the midsole member 904 includes a retaining member 908 that engages a corresponding retaining member 910 provided on the impact-attenuating element 902. These retaining members 908 and 910 are described in more detail below.

Retaining member 908 includes a raised ring member 912 that includes a plurality of tab elements 912*a*. Retaining member 910 includes an opening 914 defined in the top base member 902*a* of the impact-attenuating element 902. The outer edge of the opening 914 is defined so as to include recess areas 914*a* sized and arranged so as to allow entry of the tab elements 912*a* of retaining member 908. In use, the tab elements 912*a* are pushed through the recess areas 914*a*, and then the impact-attenuating element 902 is rotated with respect to the midsole member 904 (e.g., one-eighth or one-fourth of a complete turn) so that the tab elements 912*a* move away from the recess areas 914*a* and engage behind retaining elements 914*b* defined around the outer edge of opening 910. The tab elements 912*a*, recess areas 914*a*, and retaining elements 914*b* are arranged such that when the tab elements 912*a* are properly inserted into the recesses 914*a* and engaged with retaining elements 914*b*, the outer edge of the impact-attenuating element 902 will smoothly fit between retaining lips 906*a* through 906*d*. If desired, the retaining member 908 and/or the top surface 902*a* of the impact-attenuating element 902 may include rotation stops that prevent over-rotation of the impact-attenuating element 902 with respect to the other portion of the foot-receiving device structure.

Similarly, if desired, the impact-attenuating element 902 may be removed from the midsole member 904 (or other portion of the foot-receiving device structure 900) by turning the impact-attenuating element 902 with respect to the midsole member 904 such that the tab elements 912*a* move away from the retaining elements 914*b* and align with the recess areas 914*a*. The tab elements 912*a* then may be moved through the recess areas 914*a* to disengage the impact-attenuating element 902 from the foot-receiving device structure 904.

Of course, many variations in the structures involved in the above-described turnbuckle arrangement may be made without departing from the invention. For example, if desired, the impact-attenuating element 902 may carry the raised ring and tab elements, and the midsole member 904 (or other portion of the foot-receiving device) may define the opening, including the recess areas and retaining elements. The number, sizes, shapes, locations, orientations, and/or other characteristics of the retaining members 908 and/or openings 910 (including tabs, recesses, retaining members, etc.) may be changed and widely varied without departing from the invention.

If desired, the turnbuckle type system described in conjunction with FIGS. 9A through 9C may be the sole system that releasably engages the impact-attenuating element 902 with the remainder of the foot-receiving device structure (e.g., like the structure illustrated in FIG. 8). Alternatively, if desired, one or more other releasable engaging elements may be included in the overall foot-receiving device structure without departing from the invention, such as hook-and-loop fasteners, retaining straps, snap fasteners, etc. Also, the bottom base member 902*b* may function as a portion of the outsole for the foot-receiving device (e.g., it may include traction elements and/or be constructed of a suitable material so as to allow it to function as an outsole). Alternatively, if desired, another outsole member may cover the bottom base member 902*b* without departing from the invention. As still another example, if desired, the bottom base member 902*b* may be omitted or moved to the central portion of the impact-attenuating members 902*c*, and the bottom of impact-attenuating members 902*c* may be constructed from materials and/or include traction elements so that they could function directly as an outsole member and/or an independent outsole member may directly cover these impact-attenuating members 902*c*. Many other variations in the structures and elements involved in the foot-receiving device structure 900 are possible without departing from this invention.

Figure 10A:
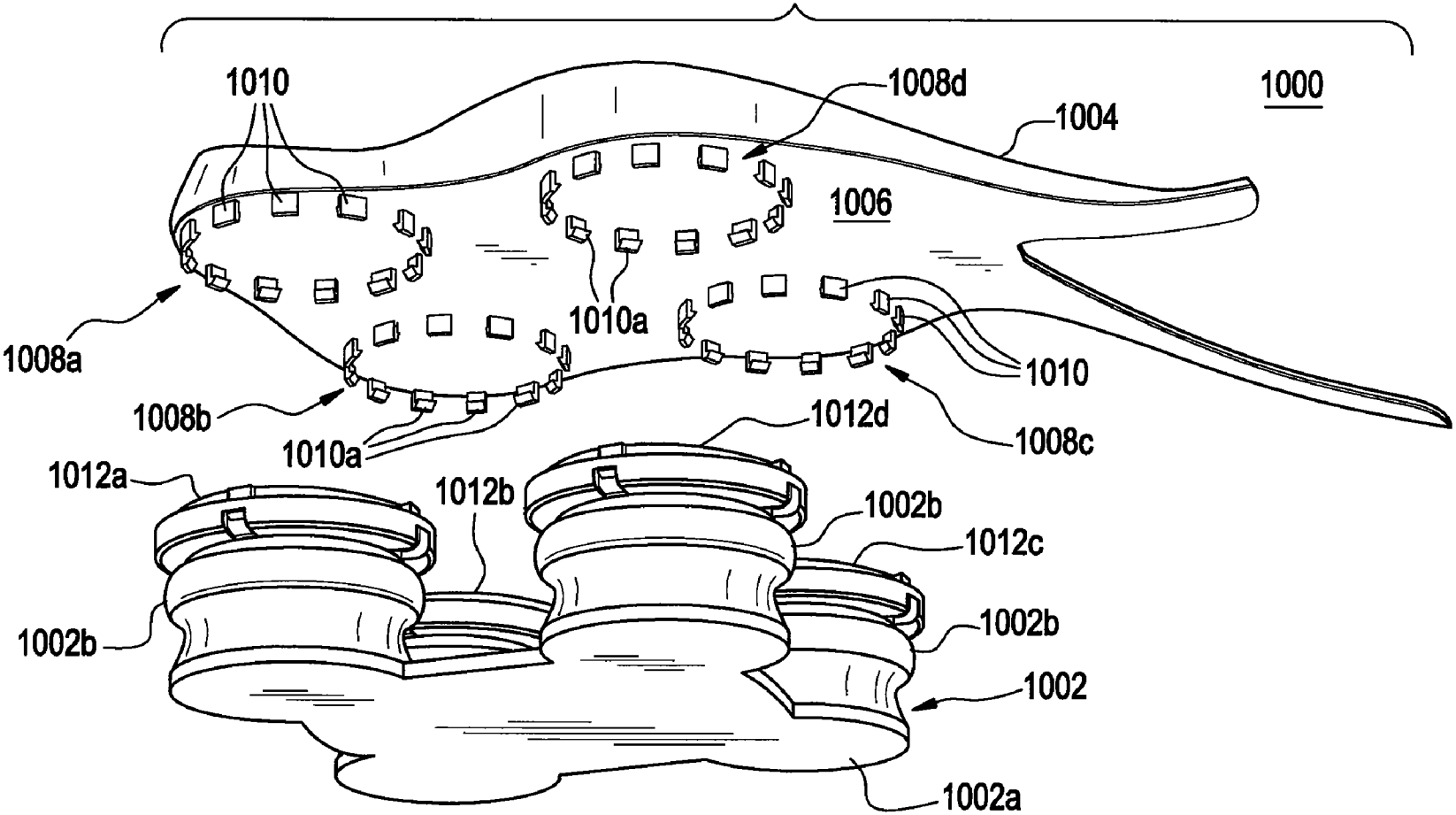
FIGS. 10A through 10C illustrate additional details of an example clip or clasp type system for releasably engaging an impact-attenuating element to a portion of a foot-receiving device.
Figure 10B:
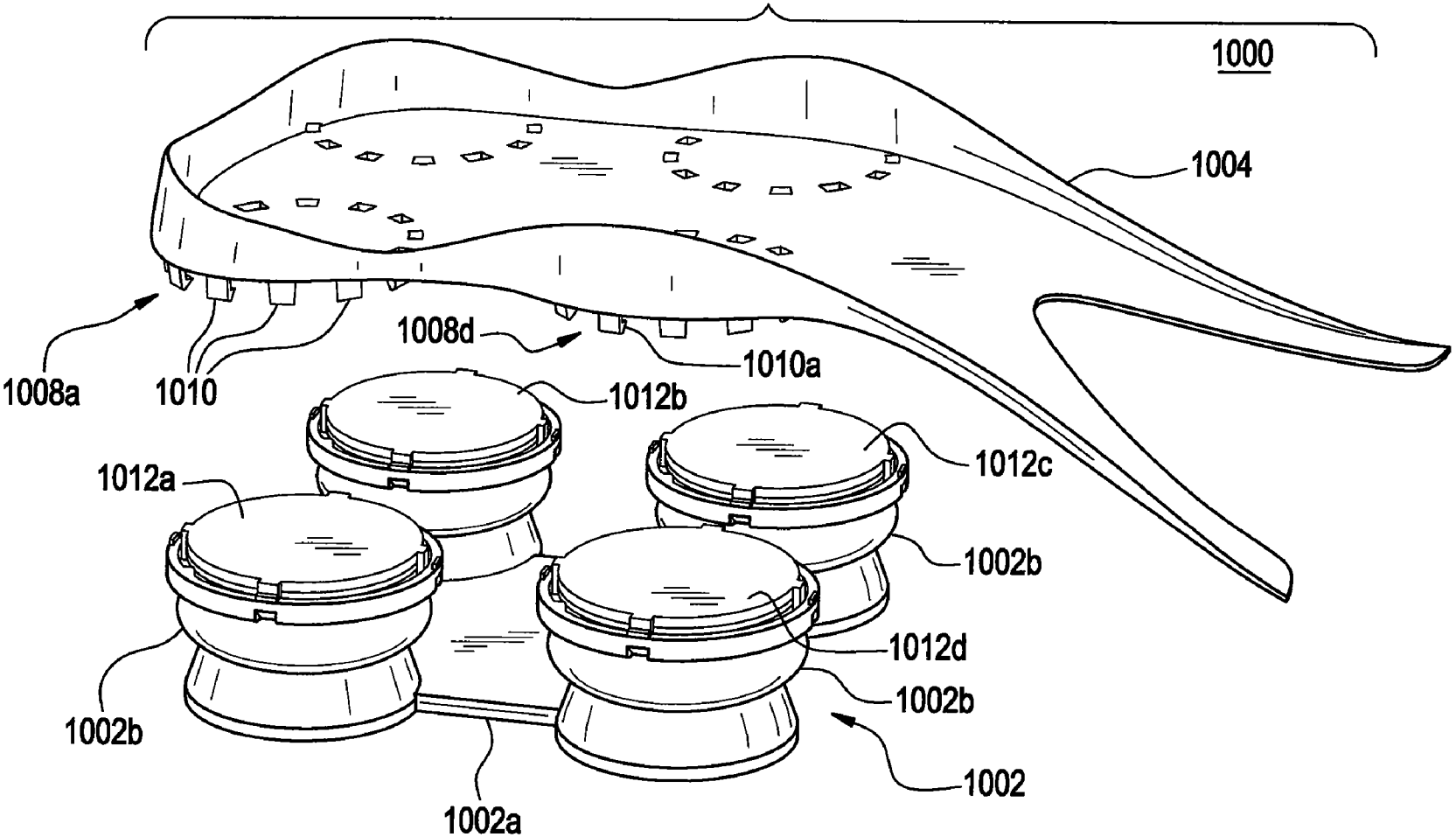
Figure 10C:
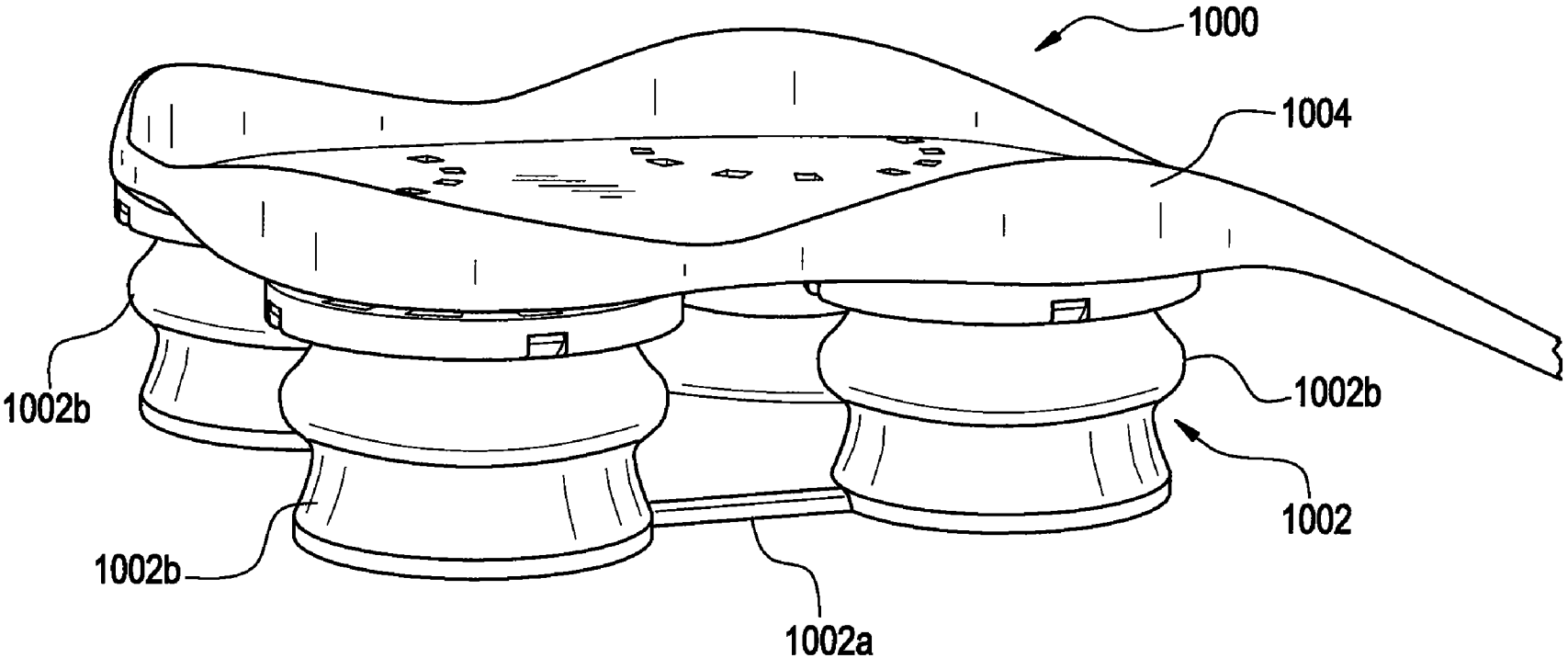

FIGS. 10A through 10C illustrate another example arrangement for releasably engaging an impact-attenuating element 1002 to the remainder of a foot-receiving device structure 1000. In this illustrated example, the impact-attenuating element 1002 is releasably engaged with a midsole member 1004, although it may be engaged with an insole member, an outsole member, an upper member, or another portion of a foot-receiving device structure without departing from the invention.

In this illustrated example, the impact-attenuating element 1002 does not include an upper or top base member, but rather, a single bottom base member 1002*a* engages and holds the impact-attenuating members 1002*b* together as a unitary structure. If desired, the base member 1002*a* may be located at an intermediate position between the tops and bottoms of impact-attenuating members 1002*b*. The midsole member 1004, in this example structure, includes a surface 1006 that has a plurality of retaining members 1008*a* through 1008*d*. Each retaining member 1008*a* through 1008*d* in this example structure includes a plurality of retaining elements 1010, which in this illustrated example include projections extending from the surface 1006. The end of each projection 1010 may include an extending lip 1010*a*.

An upper portion of each impact-attenuating member 1002*b* includes a raised ridge structure 1012*a* through 1012*d*. These raised ridges 1012*a* through 1012*d* may be integrally formed as a one piece structure with the outer surface of the impact-attenuating member structure 1002*b*, or they may be constructed as separate ring elements attached to the impact-attenuating member 1002*b* in some manner, such as through adhesives, slots, mechanical connectors, a friction fit, etc. The retaining elements 1010 are sized and arranged so as to fit over the raised ridge structures 1012*a* through 1012*d* provided with the impact-attenuating members 1002*b* such that the extending lips 1010*a* extend around their respective raised ridges 1012*a* through 1012*d* and snuggly engage the underside of these ridges 1012*a* through 1012*d*.

In at least some examples of the invention, the retaining elements 1010 will be stiff enough to firmly engage the raised ridges 1012*a* through 1012*d* and hold to them, yet resilient enough to clip or snap over the raised ridges 1012*a* through 1012*d* to engage these elements together. Additionally, the retaining elements 1010 of this example will be resilient enough to allow the retaining elements 1010 to be disengaged from the raised ridges 1012*a* through 1012*d* so that the impact-attenuating element 1002 may be removed from the midsole member 1004 (or other portion of the foot-receiving device structure).

Many variations in the retaining element 1010 and/or raised ridge structure 1012*a* through 1012*d* are possible without departing from the invention. For example, the retaining element projections 1010*a* may fit into recesses or openings provided in the raised ridge structure 1012*a* through 1012*d* and/or the impact-attenuating member structure 1002*b* and optionally then turn to engage retaining elements provided in the raised ridge structure 1012*a* through 1012*d* (e.g., akin to the turnbuckle arrangement shown in FIGS. 9A through 9D). As another example, the retaining element projections may be provided on the impact-attenuating element and suitable retaining elements may be provided on the other portion of the foot-receiving device structure (e.g., on the midsole, insole, outsole, and/or upper members). As still another example, a mechanical arrangement, such as one or more spring elements, may be provided to move (e.g., extend or constrict) the retaining elements 1010 and/or move (e.g., extend or constrict) the raised ridges 1012*a* through 1012*d* so that the impact-attenuating element 1002 may be freely and easily attached to and/or removed from the midsole member 1004 and/or still allow these elements to be firmly attached to one another.

As described above in conjunction with the structure illustrated in FIGS. 9A through 9C, the bottom base member 1002*a* of the impact-attenuating element 1002 may be exposed in the final foot-receiving device structure and may be constructed so as to function as a portion of the outsole member for the foot-receiving device (e.g., the bottom surface of base member 1002*a* may be constructed of a material and/or include traction elements so as to make it suitable for use as an outsole member). Alternatively, if desired, some or all of the bottom surface of base member 1002*a* may be covered in the final foot-receiving device structure, e.g., by a separate outsole member, without departing from the invention. As still another potential alternative, the base member 1002*a* may be moved upward in the impact-attenuating device structure 1002 and the bottom of the impact-attenuating members 1002*b* may function as the outsole for the foot-receiving device structure.

Additional aspects of this invention relate to methods for providing footwear or foot-receiving devices that include impact-attenuating element(s) of the type described above. As mentioned above, the impact-attenuating characteristics of footwear or other foot-receiving devices according to examples of this invention can be easily changed, for example, by replacing one impact-attenuating element with another having different characteristics.

Various factors may be taken into consideration when determining the specific characteristics of one or more impact-attenuating elements to place in a given piece of footwear or other foot-receiving device. For example, characteristics of the impact-attenuating element(s) may be selected based on one or more characteristics of the intended end user, such as: the user's weight, the user's shoe size, the user's foot width, the user's moving speed, the user's jumping ability, the user's stride or gait characteristics (e.g., a pronation or supination tendency, etc.), and the like. Also, the characteristics of the impact-attenuating element(s) may be selected depending on one or more characteristics of the final intended end use of the footwear or other foot-receiving device product. For example, different impact-attenuating element(s) (e.g., elements having different stiffnesses) may be selected depending on whether the footwear or foot-receiving device is used for walking, running, basketball, soccer, football, baseball, softball, sprinting, various track events, various field events, cross-training, video game play, training exercises, etc.

The potential variability features of impact-attenuating element(s) according to examples of the invention allow manufacturers, wholesalers, retailers, users, coaches, trainers, or others to selectively determine and/or change the characteristics of a piece of footwear or other foot-receiving device by selecting different impact-attenuating element(s) for inclusion in these devices. In this manner, if desired, manufacturers, wholesalers, retailers, users, or others can customize a pair of footwear or other foot-receiving device, e.g., based on one or more characteristics of the intended user, one or more characteristics of the ultimate intended end use of the product, user preference, etc. Moreover, this customization can take place at any stage in the distribution chain, for example, at the construction factory by the manufacturer, by wholesalers or retailers (e.g., at a warehouse or a point of sale location, to replenish depleted stock, etc.), by consumers at the time and/or after the product has been purchased, by trainers or coaches, etc. As one example, the characteristics of the impact-attenuation element(s) may be selected at the assembly factory for a given pair of shoes, and these shoes then may be marketed specifically targeted to specific users or use characteristics (e.g., the sales box and/or a tag on the shoe might indicate that the shoe is designed for running or jogging for a user between 165 and 180 lbs.). Shoes for a series of different uses and for different user weights (or other characteristics) then may be marked on boxes or tags (depending on the characteristics of the impact-attenuating element used) and placed in the market.

As another example, shoe retailers or wholesalers may have a supply of impact-attenuating elements available to insert into the footwear or other foot-receiving device at the point of sale location, e.g., based on the characteristics of the intended user, the intended use, user preference, to replenish depleted stock, etc. As still another example, users may be allowed to freely select and/or change impact-attenuating elements, based on their immediate needs and/or the characteristics they desire in the footwear or other foot-receiving devices (e.g., by switching one impact-attenuating element for another at a point of use location). Impact-attenuating elements labeled with various different characteristics (e.g., for different user characteristics or intended use characteristics as described above) may be made available to the users. These aspects of the invention work particularly well for footwear and foot-receiving device designs in which the impact-attenuating element(s) remain visible and/or are otherwise easily accessible by the user after the device is fully assembled.

As another example, methods according to aspects of the invention further may include providing at least an upper member and a sole member (e.g., an outsole member, a midsole member, an insole member, etc.) for a piece of footwear or other foot-receiving device. Based at least in part on a characteristic of an intended user of the piece of footwear or the device or a characteristic of an intended use of the piece of footwear or device, an impact-attenuating element may be selected or identified for inclusion in the piece of footwear or in the device. As mentioned above, this selection may occur, for example, at the manufacturing location, at a wholesaler location, at a retailer location, after retail purchase, at a point of use location, through use of an on-line internet site, etc. The selected impact-attenuating element then may be included at the desired location in the piece of footwear or other foot-receiving device, e.g., between the upper member and a portion of the sole member, attached to the upper member or a portion of the sole member, etc.

If desired, a user may change the characteristics of a piece of footwear or other foot-receiving device by removing one impact-attenuating element and replacing it with a new one. This feature also can be used for any other desired reason, e.g., to replace a broken impact-attenuating element, to customize a foot-receiving device for a new user, customize a foot-receiving device for changing user or use conditions, etc. Impact-attenuating elements of the type described above also may be provided in the arch area of a foot-receiving device to provide support for the arch, if desired.

D. CONCLUSION

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A foot-receiving device, comprising:

an upper;

an outsole member engaged with the upper, wherein the outsole member includes an outsole flap including a retaining extension; and an impact-attenuating element releasably engaged with the upper, wherein the impact-attenuating element includes: (a) a first base member, (b) a second base member, and (c) a plurality of impact-attenuating members provided at least partially between the first base member and the second base member, wherein the retaining extension of the outsole flap extends around the impact-attenuating element and engages a retaining element provided at a rear heel area of the foot-receiving device to releasably engage the impact-attenuating element and to at least in part hold the impact-attenuating element in place with respect to the upper.

2. A foot-receiving device according to claim 1, wherein the outsole flap includes a plug member that engages an opening defined in a surface of the first base member.

3. A foot-receiving device according to claim 1, wherein the foot-receiving device is an article of footwear.

4. A foot-receiving device, comprising:

an upper;

an outsole member engaged with the upper, wherein the outsole member includes an outsole flap; and an impact-attenuating element releasably engaged with the upper, wherein the impact-attenuating element includes: (a) a first base member, (b) a second base member, and (c) a plurality of impact-attenuating members provided at least partially between the first base member and the second base member, wherein at least a portion of the outsole flap is made from an elastomeric material that stretches around the impact-attenuating element to a retaining element provided at a rear heel area of the foot-receiving device to releasably engage the impact-attenuating element and to at least in part hold the impact-attenuating element in place with respect to the upper.

5. A foot-receiving device according to claim 4, wherein an exterior surface of the first base member includes one or more outsole traction elements.

6. A foot-receiving device according to claim 4, wherein the outsole flap includes a plug member that engages an opening defined in a surface of the first base member.

7. A foot-receiving device according to claim 4, wherein the outsole flap extends at least partially across a major surface of the first base member between at least some of the plurality of impact-attenuating members.

8. A foot-receiving device according to claim 4, wherein the foot-receiving device is an article of footwear.

9. A foot-receiving device according to claim 1, wherein the outsole flap extends at least partially across a major surface of the first base member between at least some of the plurality of impact-attenuating members.

10. A foot-receiving device, comprising:

an upper;

an outsole member engaged with the upper, wherein the outsole member includes an outsole flap including a retaining extension; and an impact-attenuating element releasably engaged with the upper, wherein the impact-attenuating element includes: (a) a first base member and (b) a plurality of impact-attenuating members engaged with the first base member, wherein the retaining extension of the outsole flap extends around the impact-attenuating element and engages a retaining element provided at a rear heel area of the foot-receiving device to releasably engage the impact-attenuating element and to at least in part hold the impact-attenuating element in place with respect to the upper.

11. A foot-receiving device according to claim 10, wherein an exterior surface of the first base member includes one or more outsole traction elements.

12. A foot-receiving device according to claim 10, wherein the outsole flap includes a plug member that engages an opening defined in a surface of the first base member.

13. A foot-receiving device according to claim 10, wherein the foot-receiving device is an article of footwear.

14. A foot-receiving device, comprising:

an upper;

an outsole member engaged with the upper, wherein the outsole member includes an outsole flap; and an impact-attenuating element releasably engaged with the upper, wherein the impact-attenuating element includes: (a) a first base member and (b) a plurality of impact-attenuating members engaged with the first base member, wherein at least a portion of the outsole flap is made from an elastomeric material that stretches around the impact-attenuating element to a retaining element provided at a rear heel area of the foot-receiving device to releasably engage the impact-attenuating element and to at least in part hold the impact-attenuating element in place with respect to the upper.

15. A foot-receiving device according to claim 14, wherein an exterior surface of the first base member includes one or more outsole traction elements.

16. A foot-receiving device according to claim 14, wherein the outsole flap includes a plug member that engages an opening defined in a surface of the first base member.

17. A foot-receiving device according to claim 14, wherein the outsole flap extends at least partially across a major surface of the first base member between at least some of the plurality of impact-attenuating members.

18. A foot-receiving device according to claim 14, wherein the foot-receiving device is an article of footwear.

19. A foot-receiving device according to claim 10, wherein the outsole flap extends at least partially across a major surface of the first base member between at least some of the plurality of impact-attenuating members.

20. A foot-receiving device according to claim 1, wherein an exterior surface of the first base member includes one or more outsole traction elements.

* * * * *